United States Patent [19]

Yacobian

[11] Patent Number: 4,895,261

[45] Date of Patent: Jan. 23, 1990

[54] DISPLAY RACK ASSEMBLY

[76] Inventor: Ara Yacobian, 30 Rathbun Rd., Natick, Mass. 01760

[21] Appl. No.: 357,777

[22] Filed: May 30, 1989

[51] Int. Cl.[4] ..... A47F 5/00

[52] U.S. Cl. ..... 211/196; 211/197; 211/167

[58] Field of Search ..... 211/163, 197, 205, 167, 211/196

[56] References Cited

U.S. PATENT DOCUMENTS

| | | | |
|---|---|---|---|
| 116,455 | 6/1871 | Lee . | |
| 123,051 | 1/1872 | Sheldon . | |
| 351,373 | 10/1886 | Gordon | 211/197 |
| 430,970 | 6/1890 | Reed . | |
| 443,920 | 12/1890 | Reed | 211/163 |
| 1,654,427 | 12/1927 | Modlarz . | |
| 1,692,311 | 11/1928 | Rader . | |
| 3,692,617 | 9/1972 | Marks et al. | 211/205 X |

*Primary Examiner*—Robert W. Gibson, Jr.

[57] ABSTRACT

A display rack assembly comprising a base portion, a tubular member fixed to the base portion and extending upwardly therefrom, a rod removably and rotatably mounted in the tubular member and extending upwardly therefrom, a bracket portion fixed to the upper end of the rod, a plurality of strut members pivotally attached to the bracket portion, a beam member pivotally attached to each strut member, retention structure on the rod for releasably retaining ends of the beam members, the strut members being provided with notches, and hoops of different diameters being adapted to be retained by the notches, whereby there is provided a collapsible display rack.

10 Claims, 4 Drawing Sheets

DISPLAY RACK ASSEMBLY

BACKGROUND OF THE INVENTION

1. Field of the Invention

This invention relates to display racks and is directed more particularly to a collapsible display rack assembly.

2. Description of the Prior Art

It is commonplace for merchants to display their wares by means of racks adapted to retain and display a number of items for sale. In the retail clothing industry, it is well known to provide racks for displaying ties, belts, slacks, shirts, and the like.

One type of display rack known in the art comprises a base member, a post upstanding from the base member and which may be rotatable, a number of strut members fixed to and extending from the upper end of the post downwardly and outwardly to define a generally conical-shaped skeletal structure. The strut members are provided with means for retaining hoops, or rings, which are positioned in different horizontal planes on the strut members. The hoops serve as retaining means for ties and the like, which may be looped over the hoops and allowed to hang therefrom. Such racks facilitate the display of large numbers of ties in a manner easily accessible to prospective purchasers.

A problem experienced with racks of the type above described is that they occupy a relatively large amount of floor space. When it is desired to place such racks in a storage area, the space occupied by such racks can present problems relative to available storage floor space. Further, because the struts extend outwardly from the central post and the hoops are generally welded, or otherwise fixed to the strut members, the racks are awkward and difficult to handle in moving about.

SUMMARY OF THE INVENTION

Accordingly, an object of the present invention is to provide a display rack assembly which in use can duplicate the display advantages of the rack described above, but which has the added advantage of being readily collapsible, so that the apparatus may readily be moved and stored in limited space.

With the above and other objects in view, as will hereinafter appear, a feature of the present invention is the provision of a display rack assembly comprising a base portion, a tubular member fixed to the base portion and extending upwardly therefrom, a rod removably and rotatably mounted in the tubular member and extending upwardly therefrom, a bracket portion fixed to the upper end of the rod, bracket portion, a beam member pivotally attached to each a plurality of strut members pivotally attached to the strut member, retention structure on the rod for releasably retaining ends of the beam members, the strut members being provided with notches, and hoops of different diameters being adapted to be retained by the notches, whereby there is provided a collapsible display rack.

The above and other features of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
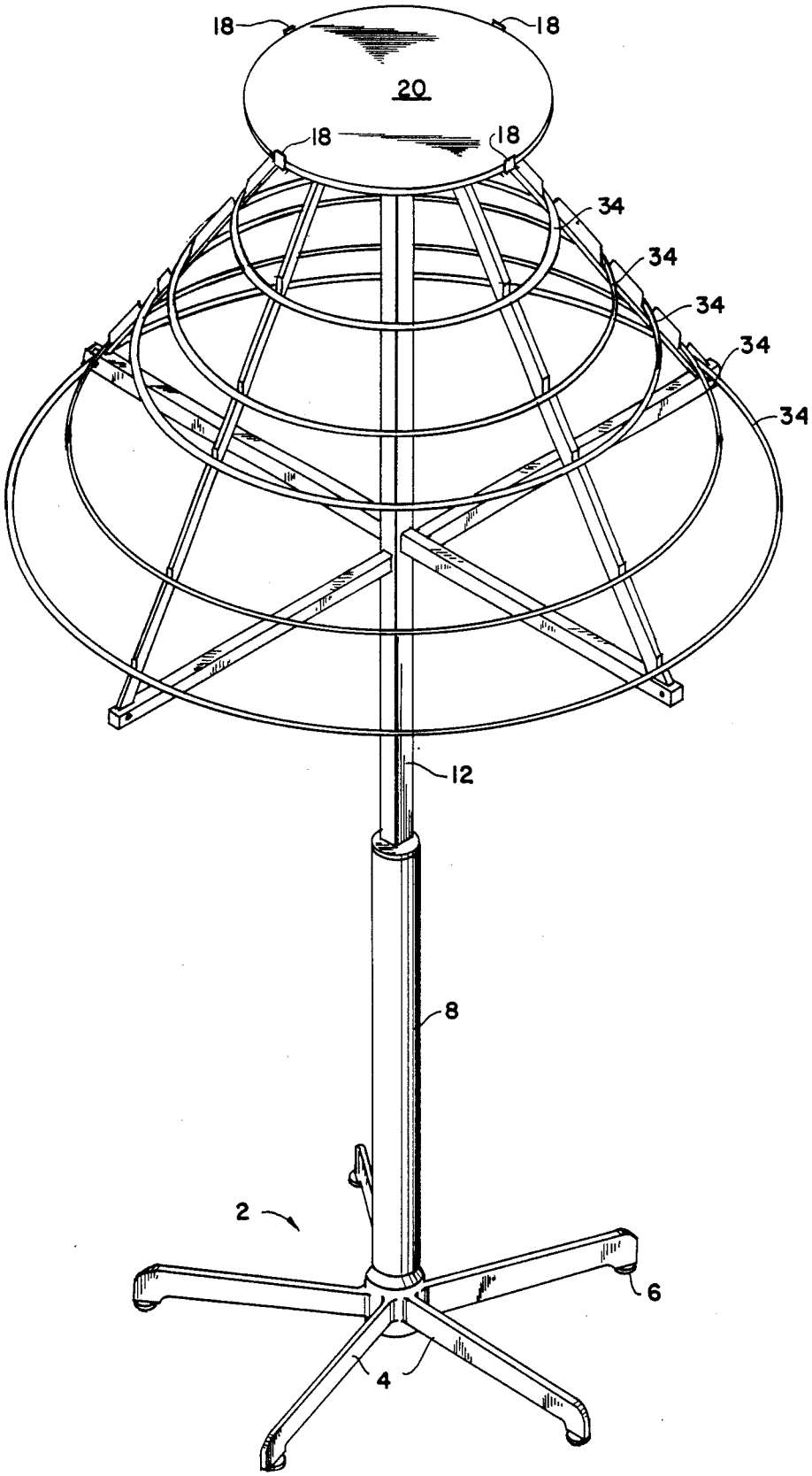
FIG. 1 is a perspective view of one form of display rack assembly illustrative of an embodiment of the invention.

Referring to the drawings, it will be seen that the illustrative display rack assembly includes a base portion 2 having legs 4 which may be provided with foot members 6, or rollers (not shown). A tubular member 8 is fixed to the base portion 2 and extends vertically therefrom. In the interior of the tubular member 8 there are disposed bearings 10 (FIG. 3) which are attached to a rotatable central rod 12, the rod 12 extending upwardly from the upper end of the tubular member 8. The rod 8 may itself comprise a tubular member, but for purposes of description will be referred to herein as a "rod".

Fixed to the upper and free end of the central rod 11 is a bracket portion 14 (FIG. 2) which extends radially from the rod free end. The bracket portion 14 may comprise a plurality of arms 16 provided at their outer ends with flanges 18 upstanding from the arms 16.

A top member 20 is adapted to be seated upon the arms 16 and within the flanges 18. The top member 20 is preferably planar and may be used as a shelf for the display of additional goods, or for the display of a decorative or advertising item.

Pivotally attached to each of the bracket portion arms 16 is a strut member 22 having notch means 24 therein. The strut members 22 are pivotally moveable on the bracket portion 14 to a first position, as illustrated in FIGS. 1–3, and to a second position, as illustrated in FIG. 5; that is, to an operative position (FIGS. 1–3) and to a collapsed position (FIG. 5).

Figure 2:
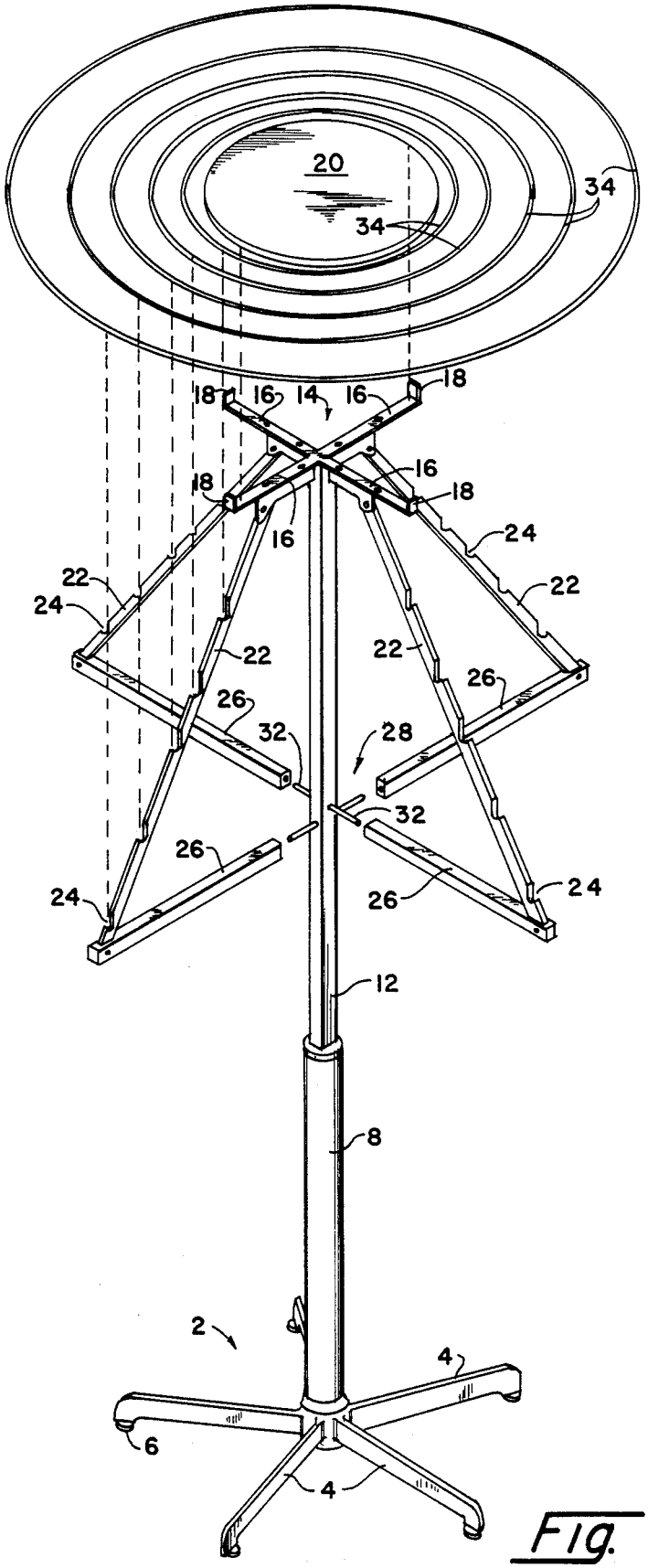
FIG. 2 is a perspective view, similar to FIG. 1, but illustrating the collapsibility feature.
Figure 3:
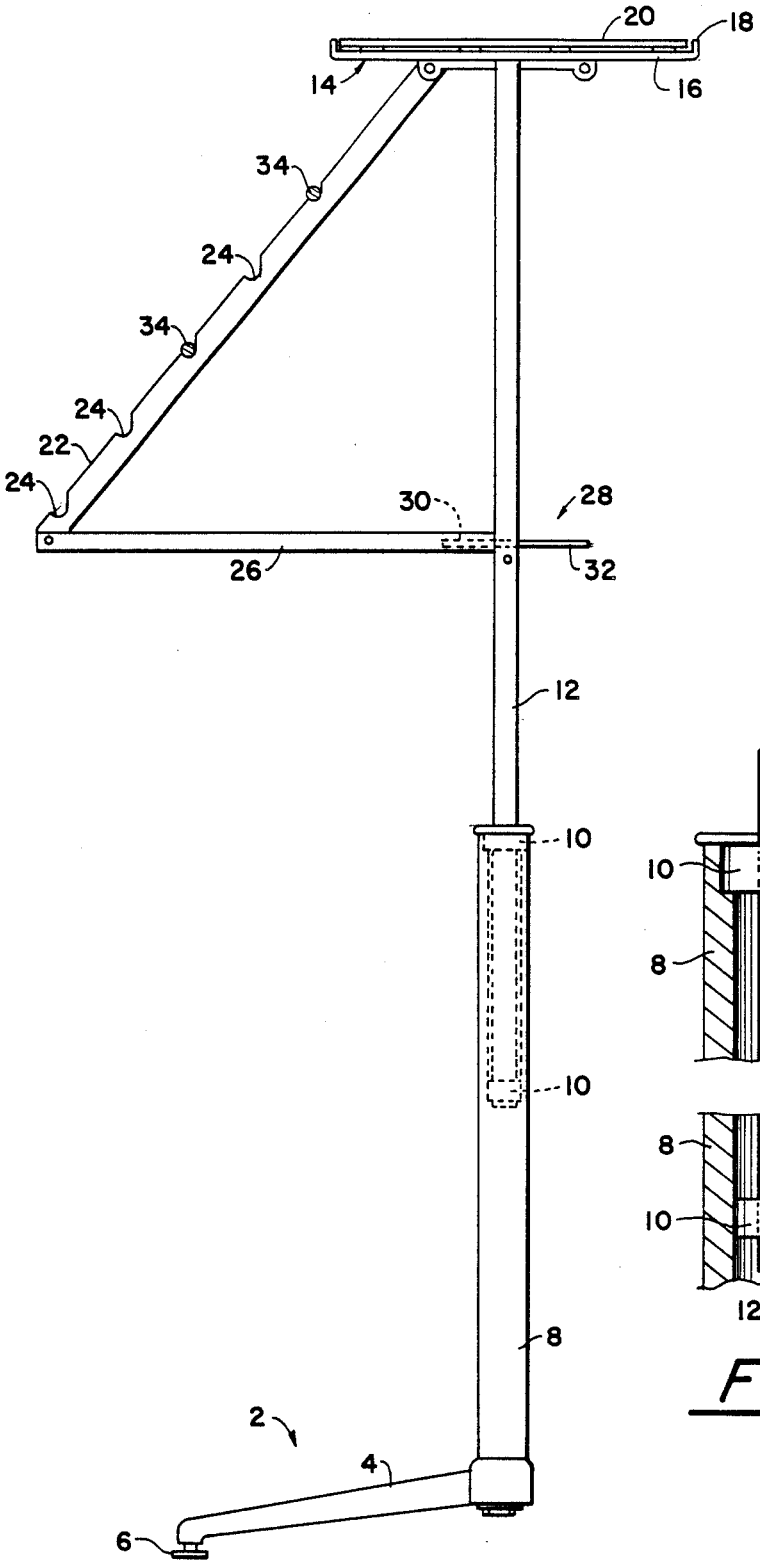
FIG. 3 is a partial side elevational view.
Figure 5:
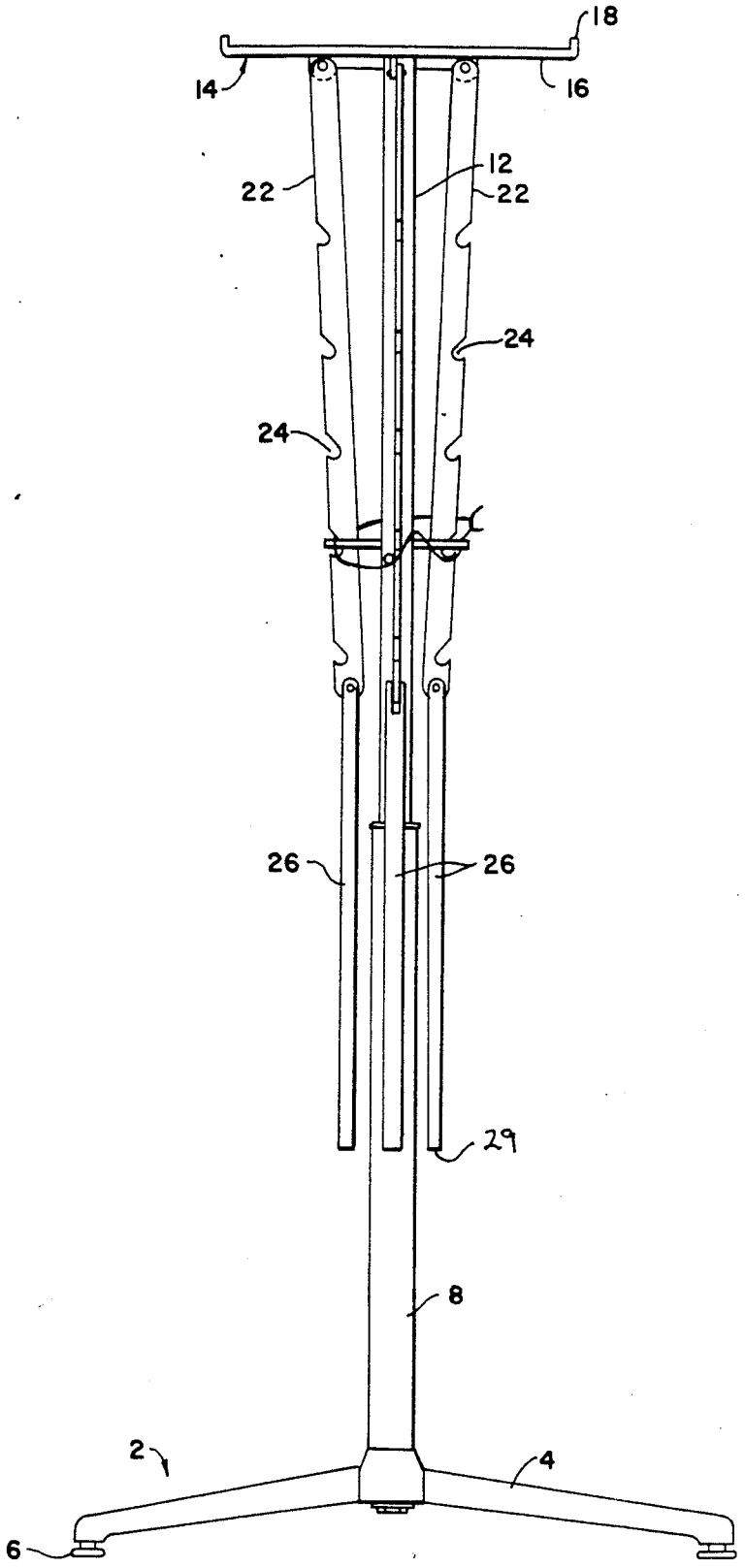
FIG. 5 is a side elevational view of the display rack assembly in its collapsed configuration.

To each strut member 22 lower end there is pivotally attached a beam member 26 which is adapted selectively to be positioned as shown in FIGS. 1–3, and to be positioned as shown in FIG. 5.

The central rod 12 is provided with retention means 28 for releasably retaining distal ends 29 (FIG. 2) of the beam members 26. The retention means 28 may, for example, comprise holes 30 in the central rod 12, the holes extending through the rod, and dowels 32 (FIGS. 2 and 3) adapted for disposition in the holes 30, the dowels extending radially outwardly from the rod 12. The beam members 26 may be of a C-channel structure, or may otherwise be provided with recesses in their distal ends 29 adapted to engage with the dowels 32 to retain the beam members 26 in a substantially horizontal position.

The assembly is further provided with a number of hoops, or ring members 34 adapted to set in the notch means 24, the notch means being adapted to retain the hoops 34 in a substantially horizontal position on the strut members 22.

Referring to FIG. 3, it will be seen that the hoops 34 are, in cross section, substantially round. The hoops may be of any rigid material and may be made of rod or tubular stock. The notches 24 are complementarily rounded to accept the hoops therein.

As may be seen in FIG. 1, in the operative position the hoops 34 are disposed on the strut members 22, in the notches 24. The hoops are of different circumferences such that the hoop of largest circumference, the lower-most shown in FIG. 1, occupies the lower-most notches, and the hoop of smallest circumference, the upper-most shown in FIG. 1, occupies the upper-most notches.

Referring to FIG. 2, it will be seen that all the hoops 34 may be lifted from the notch means 24 and disposed in a single plane, the hoops being sized so as to fit concentrically on a planar storage area. The top member 20 is adapted to be disposed for storage within the smallest hoop.

To collapse the remainder of the assembly, the distal ends 29 of the beam members 26 are removed from the dowels 32 (FIG. 2) and the strut members 22 and beam members 26 allowed to pivot to the position shown in FIG. 5. The strut members 22 are all of substantially the same length and the beam members 26 are all of substantially the same length. The length of a strut member 22 combined with the length of a beam member 26 is less than the length of the tubular member 8 and the exposed length of the central rod 12 combined. Accordingly, in the FIG. 5 position, the strut members 22 extend alongside the central rod 12 and the beam members 26 extend alongside the rod 12 and the tubular member 8, with the distal ends 29 of the beam members 26 being disposed alongside the tubular member 8.

Figure 4:
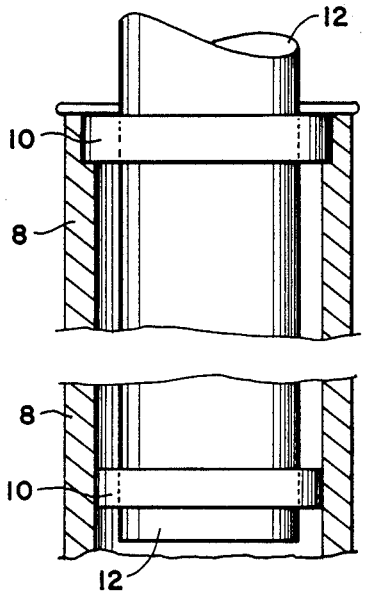
FIG. 4 is an enlarged detailed sectional view of a portion of the apparatus shown in FIG. 3.

If desired, the rod 12 may be lifted out of the tubular member 10. Referring to FIG. 4, it will be seen that the upper 10*a* of the two bearings 10 is seated upon a shoulder surface 36 on the interior wall of the tubular member 8. The lower 10*b* of the two bearings is of slightly smaller diameter than the bearing 10*a* and may be slid into and out of the tubular member 8. Accordingly, the central rod 12 may easily be lifted from, and separated from, the tubular member.

Thus, there is provided a display rack assembly which may be collapsed in an easy and safe manner for movement and storage.

In an alternative embodiment (not shown), the apparatus may be provided with D-shaped hoops, rather than annularly-shaped hoops, for racks intended for use against walls. In such embodiment, one of the strut members and associated beam member are omitted.

In another alternative embodiment (not shown), the apparatus may be provided with pie-shaped hoops for racks intended for use in corners. In such embodiments, the strut members and beam members are arranged accordingly.

The device may be rendered further collapsible by adapting the tubular member 8 for removal from the base member 2. The tubular member may, for example, threadedly engage the base member.

It is to be understood that the present invention is by no means limited to the particular construction herein disclosed and/or shown in the drawings, but also comprises any modifications or equivalents within the scope of the disclosure.

Having thus described my invention, what I claim as new, and desire to secure by Letters Patent of the United States is:

1. A display rack assembly comprising a base portion, a tubular member fixed to said base portion and extending vertically therefrom, a rod rotatably mounted in an end of said tubular member remote from said base portion and extending axially therefrom, a bracket portion fixed to a free end of said rod and extending radially therefrom, a plurality of strut members pivotally attached to said bracket portion, a beam member pivotally attached to each of said strut members at ends of said strut members remote from said bracket portion, said rod having retention means thereon between said bracket portion and said tubular member for releasably retaining distal ends of said beam members such that said beam members are retained in a position generally normal to said rod, said strut members being provided with notches therein, and hoops adapted to set in said notches, said strut member notches being adapted to retain said hoops in a substantially horizontal position on said strut members.

2. The display rack assembly in accordance with claim 1 in which said bracket portion comprises a plurality of arms extending radially from said rod, each of said strut members being pivotally connected to one of said bracket portion arms.

3. The display rack assembly in accordance with claim 2 in which outer ends of said bracket portion arms are provided with flanges upstanding from said arms, and a top member adapted to be seated on said arms and within an area bounded by said flanges.

4. The display rack assembly in accordance with claim 1 in which said retention means comprises holes in said rod extending through said rod width-wise, and dowels adapted for disposition in said holes, said dowels extending radially outwardly from said rod, said beam members at their distal ends having recesses adapted to engage with said dowels for retaining said beam members in said substantially horizontal position.

5. The display rack assembly in accordance with claim 1 in which said hoops are substantially round in cross-section.

6. The display rack assembly in accordance with claim 1 in which said hoops are of different circumferences, the hoop of largest circumference being adapted to occupy the lower-most notches and the hoop of least circumference being adapted to occupy the upper-most notches.

7. The display rack assembly in accordance with claim 1 in which said strut members are of substantially equal length and said beam members are of substantially equal length.

8. The display rack assembly in accordance with claim 7 in which said length of one of said strut members and said length of one of said beam members combined is less than the exposed length of said rod and said tubular member combined.

9. The display rack assembly in accordance with claim 6 in which said hoops are adapted to be placed concentrically in a single plane.

10. The display rack assembly in accordance with claim 8 in which said strut members are adapted to move pivotally to a position in which said strut members extend alongside said rod, and said beam members when not connected at their free ends to said rod are adapted to move pivotally to a position alongside said rod and said tubular member, with said distal ends of said beam members being disposed alongside said tubular member.

* * * * *